US005299798A

United States Patent [19]

Shida

[11] Patent Number: 5,299,798

[45] Date of Patent: Apr. 5, 1994

[54] SHEET FEEDING DEVICE FOR AN IMAGE FORMING APPARATUS

[75] Inventor: Toshio Shida, Hachioji, Japan

[73] Assignee: Konica Corporation, Tokyo, Japan

[21] Appl. No.: 941,898

[22] Filed: Sep. 8, 1992

[30] Foreign Application Priority Data

Sep. 24, 1991 [JP] Japan ..... 3-243387

[51] Int. Cl.[5] ..... B65H 9/04

[52] U.S. Cl. ..... 271/245; 271/272

[58] Field of Search ..... 271/245, 272-274, 271/189

[56] References Cited

U.S. PATENT DOCUMENTS 4,620,699 11/1986 Landa et al. ..... 271/245

4,775,142 10/1988 Silverberg ..... 271/274

OTHER PUBLICATIONS

Kobus, Xerox Disclosure Journal, Integral Registration and Sheet Feeder Actuation, Apr. 1982, vol. 7, No. 2, pp. 75.

*Primary Examiner*—H. Grant Skaggs

*Attorney, Agent, or Firm*—Jordan B. Bierman

[57] ABSTRACT

A sheet feeder for feeding a transfer sheet to a transfer region of an image forming machine such as a copier and a printer. The sheet feeder has a driving roller for driving a idle roller so that the transfer sheet is nipped between the driving roller and the idle roller, and conveyed to the transfer region; the idle roller for being rotated by the movement of the driving roller, in which a hardness of the idle roller is more than 0° and not more than 60° in Asuka C Scale; and a shutter for suspending and allowing the conveyance of the transfer sheet by opening and closing operations of the shutter. The driving roller of the sheet feeder is still rotating while the shutter is suspending the conveyance of the transfer sheet.

3 Claims, 2 Drawing Sheets

SHEET FEEDING DEVICE FOR AN IMAGE FORMING APPARATUS

BACKGROUND OF THE INVENTION

The present invention relates to a sheet feeding device for an image forming apparatus which is used to feed a transfer sheet to a transfer region, and more particularly relates to a pair of conveyance rollers disposed in a conveyance passage of the sheet feeding device.

In an image forming apparatus, a relatively simple sheet feeding device is adopted which is operated in the following manner: before a transfer sheet sent out from a sheet feeding cassette is conveyed to a transfer region, it is brought into contact with a shutter member which blocks a conveyance passage and stops the sheet; the shutter member is withdrawn synchronously with the movement of a toner image formed on an image forming body; and then the transfer sheet is conveyed again.

In the simple sheet feeding device, a drive roller which is always rotated and an idle roller which comes into pressure contact with the drive roller, are adopted as a pair of conveyance rollers, and when a transfer sheet is stopped by the shutter member, the drive roller slips on the transfer sheet, so that an idling condition can be maintained.

However, the drive roller is a solid rubber roller, and the idle roller is a resin roller or a solid rubber roller. Therefore, while the drive roller is slipping on the transfer sheet, the transfer sheet is vibrated due to the friction between the drive roller and the transfer sheet, so that unpleasant noise is generated.

In order to prevent this unpleasant noise, it is effective to lower the pressing force of the idle roller against the drive roller. On the other hand, when the pressing force is lowered, the conveyance force of the transfer sheet is also lowered, so that there is a possibility that the transfer sheet can not be conveyed appropriately.

The present invention has solved the aforementioned problems, and it is a primary object of the present invention to provide a sheet feeding device for an image forming apparatus in which abnormal sound caused when a transfer sheet is vibrated during slippage, can be prevented without reducing the conveyance force.

SUMMARY OF THE INVENTION

The aforementioned object can be accomplished by a sheet feeding device for an image forming apparatus which feeds a transfer sheet synchronously with an image formed on a moving image forming body and the image is transferred onto the transfer sheet. The sheet feeding device comprises a pair of conveyance rollers to convey the transfer sheet, composed of a drive roller which is always rotated and an idle resilient sponge roller in pressure contact with the drive roller.

DETAILED DESCRIPTION OF THE INVENTION

Figure 1:
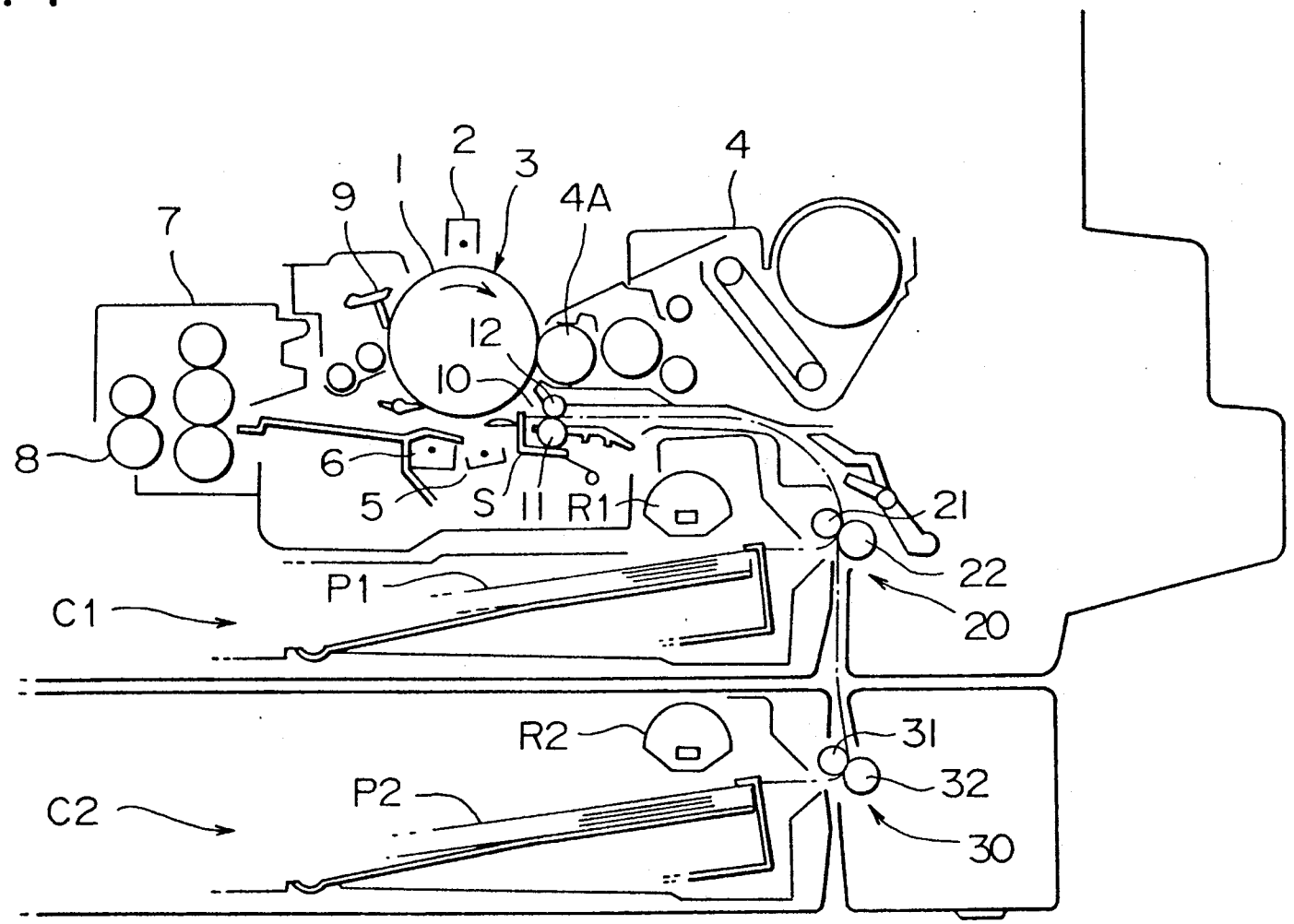
FIG. 1 is a sectional view showing the structure of the sheet feeding device of the present invention.
Figure 2:
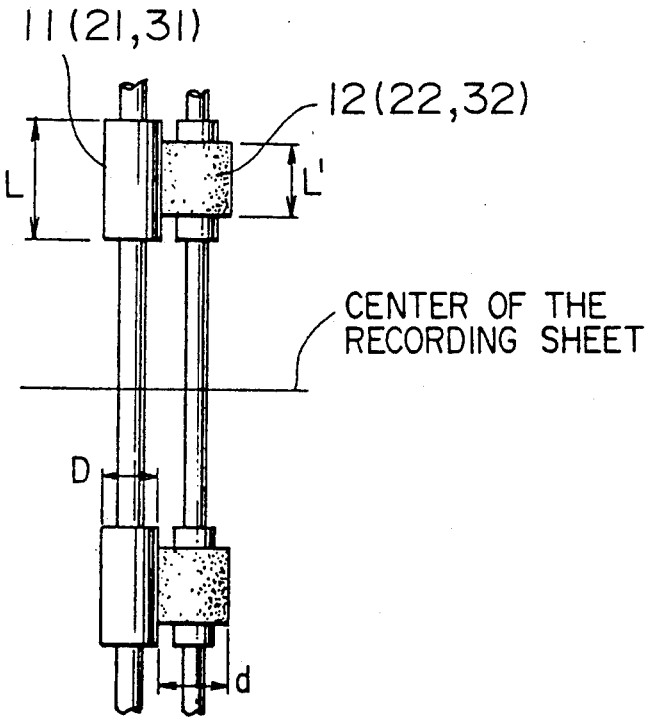
FIG. 2 is a plan view of the essential portion of the aforementioned device.

An example of the present invention is shown in FIGS. 1 and 2.

FIG. 1 is a sectional view of the sheet feeding device of an image forming apparatus. Numeral 1 is a photoreceptor drum which is an image forming body, numeral 2 is a charger, numeral 3 is an image exposure section, and numeral 4 is a developing unit. While the photoreceptor drum 1 is rotated in the direction of an arrow mark, electrical potential is impressed upon the photoreceptor drum 1 by the charger 2, and then image exposure is conducted on the photoreceptor drum 1 so that an electrostatic latent image is formed on the circumferential surface of the photoreceptor drum 1. This electrostatic latent image is developed by a developing sleeve 4A of the developing unit 4, so that the electrostatic latent image is developed into a toner image.

C 1 is a sheet feeding cassette in which transfer sheets P1 provided in the image forming apparatus are accommodated. C2 is a sheet feeding cassette in which transfer sheets P2 provided in a cassette module connected with the bottom part of the image forming apparatus, are accommodated.

The uppermost transfer sheets P1 and P2 are respectively conveyed out of the cassettes when conveyance rollers R1 and R2 are respectively rotated counterclockwise by one revolution, and the transfer sheets are conveyed in the passage shown by a one-dotted chain line.

Numerals 10, 20 and 30 are a pair of conveyance rollers which are disposed in the aforementioned transfer sheet conveyance passage. The conveyance rollers 10, 20 and 30 are composed of drive rollers 11, 21 and 31, and sponge rollers 12, 22 and 32 which come into pressure contact with the drive rollers so that they are idly rotated.

Transfer paper P1 conveyed out from sheet feeding cassette C1 is fed by the pair of conveyance rollers 20 to the pair of conveyance rollers 10, and transfer paper P2 conveyed out from sheet feeding cassette C2 is fed by the pair of conveyance rollers 30 to the pair of conveyance rollers 10. The leading edge of the conveyed transfer sheet is brought into contact with shutter member S so that the transfer sheet is temporarily stopped to wait for the toner image on the photoreceptor drum 1. While the transfer sheet is temporarily stopped, the drive roller 11, and further the drive rollers 21 and 31 in the case of a long transfer sheet, slip on the surface of the transfer sheet. Accordingly, the sponge rollers 12, 22 and 32 are maintained in a static condition.

The aforementioned drive rollers are solid rollers made of urethane rubber, EPDM, or CR rubber, the hardness of which is from 40 to 90 degrees (JIS Scale A). On the other hand, the aforementioned sponge rollers are made of resilient foamed urethane rubber, foamed urethane (ester), foamed EPDM, or foamed CR rubber, the hardness of which is $0° < H \leqq 60°$ (Asuka C Scale). In this case, "Asuka C Scale" is defined as a result of measurement carried out with "Asuka C-type rubber hardness meter" made by Kobunshi Keiki Sha Co, wherein the meter is in conformity to SRIS (Nippon Rubber Institution Standard) 0101. When the aforementioned "Asuka C-type rubber hardness meter" is used, it is possible to measure the hardness of a sponge roller which is unable to measure with the aforementioned "JIS Scale A" as it comes to indicate 0°.

When the hardness of the drive roller and that of the idle roller are discussed, it is preferable that the hardness of the drive roller is always higher than that of the idle roller. In this example, an idle roller (a sponge roller), the hardness (Asuka C Scale) of which is 30°, was used for this example.

Consequently, each sponge roller can form a wide nip portion with regard to each drive roller without reducing its torque. As a result, conveyance force generated by each drive roller is enhanced. Further, vibration caused by slippage of a transfer sheet can be absorbed by the resilient sponge roller, so that the occurrence of abnormal noise can be prevented.

Transfer sheet P1 or P2 which is brought into contact with shutter member S and stopped at a waiting position, is conveyed again when shutter member S is withdrawn synchronously when a toner image has been formed on the photoreceptor, and the toner image is transferred onto the transfer sheet. After that, the transfer sheet is separated by the separating unit 6, and then the transfer image is fixed by the fixing unit 7. Then, the transfer sheet is discharged outside of the apparatus by the discharge roller 8. After transfer sheet P1 or P2 has been separated, residual toner on the photoreceptor drum 1 is removed from the circumferential surface of the photoreceptor drum 1 by the cleaning blade 9. After that, the apparatus enters the next image forming cycle.

FIG. 2 shows an example of the layout of pairs of rollers mentioned above. The drive roller 11, the outside diameter D of which is 8 mm and the length L is 25 mm, and the sponge roller 12, the outside diameter d of which is 12 mm and the length L' is 14 mm, are combined so as to form a pair of conveyance rollers 10. The drive rollers 21, 31, the outside diameter D of which is 12 mm and the length L is 25 mm, and the sponge rollers 22, 32, the outside diameter d of which is 14 mm and the length L' is 14 mm, are combined so as to form pairs of conveyance rollers 20, 30. The aforementioned pairs of rollers are symmetrically disposed with regard to the center of the transfer sheet, so that the transfer sheet can be positively conveyed, and the occurrence of noise can be prevented.

The present invention provides a useful sheet feeding device for an image forming apparatus which can quietly and properly convey transfer sheets to the image transfer region without causing vibration and noise.

What is claimed is:

1. A sheet feeding device for feeding a transfer sheet to a transfer region of an image forming apparatus, comprising a driving roller for driving an idle roller so that said transfer sheet is nipped between said driving roller and said idle roller and conveyed to said transfer region;

said idle roller for rotation by movement of said driving roller, wherein the hardness of said idle roller is more than 0° and not more than 60° in Asuka C Scale; and a shutter for suspending and allowing conveyance of said transfer sheet by moving said shutter between a closed position, wherein said transfer sheet is nipped between said driving roller and said idle roller, and an open position, wherein said transfer sheet is not nipped between said driving roller and said idle roller;

wherein said driving roller rotates while said shutter suspends conveyance of said transfer sheet by moving said shutter to said closed position.

2. The device of claim 1, wherein a hardness of said driving roller is more than said hardness of said idle roller.

3. The device of claim 1, said hardness of said idle roller is 30° in Asuka C Scale.

* * * * *